US007025927B2

(12) United States Patent
Sakai

(10) Patent No.: US 7,025,927 B2
(45) Date of Patent: Apr. 11, 2006

(54) HOT AIR BLOWING TYPE FLUIDIZED-BED FURNACE, ROTARY HEAT-TREATMENT FURNACE, HEAT-TREATMENT APPARATUS, AND METHOD OF HEAT TREATMENT

(75) Inventor: Takayuki Sakai, Ogasa-gun (JP)

(73) Assignee: Asahi Tec Corporation, Shizuoka-prefecture (JP)

( * ) Notice: Subject to any disclaimer, the term of this patent is extended or adjusted under 35 U.S.C. 154(b) by 47 days.

(21) Appl. No.: 10/344,270

(22) PCT Filed: Jul. 17, 2001

(86) PCT No.: PCT/JP01/06158

§ 371 (c)(1),
(2), (4) Date: Feb. 10, 2003

(87) PCT Pub. No.: WO02/12813

PCT Pub. Date: Feb. 14, 2002

(65) Prior Publication Data

US 2003/0173007 A1 Sep. 18, 2003

(30) Foreign Application Priority Data

Aug. 9, 2000 (JP) ..... 2000-241325
Sep. 27, 2000 (JP) ..... 2000-294701

(51) Int. Cl.
*C22B 5/14* (2006.01)

(52) U.S. Cl. ..... 266/172; 148/698

(58) Field of Classification Search ..... 266/172; 148/698
See application file for complete search history.

(56) References Cited

U.S. PATENT DOCUMENTS 3,888,193 A * 6/1975 Kishigami et al. ..... 110/245
4,443,551 A 4/1984 Lionetti et al. ..... 502/41
4,519,718 A * 5/1985 Staffin et al. ..... 432/58
4,535,721 A 8/1985 Yakura ..... 118/503

FOREIGN PATENT DOCUMENTS

EP 0 090 641 A2 10/1983
EP 0 532 137 A1 3/1993
GB 925544 5/1963
JP 54-128412 10/1979
JP 61190015 8/1986
JP 61-185996 11/1986
JP 1-94897 6/1989
JP 2-44695 3/1990
JP 04064890 2/1992
JP 05033915 A * 2/1993 ..... 110/212
JP 2000-17413 1/2000
JP 2000-144264 5/2000

* cited by examiner

*Primary Examiner*—Scott Kastler
(74) *Attorney, Agent, or Firm*—Steptoe & Johnson LLP

(57) ABSTRACT

A heat-treatment apparatus including a first furnace for heat treatment and solution treatment of a work piece, and a second furnace for heat treatment and aging treatment of a work piece, wherein each furnace includes a dispersion tube cantilevered and immersed within a fluidized bed, the tube for blowing hot air into the fluidized bed. The first furnace includes a heat exchanger for recovering waste heat from gases discharged the first furnace for use as a heat source for the second furnace.

18 Claims, 13 Drawing Sheets

HOT AIR BLOWING TYPE FLUIDIZED-BED FURNACE, ROTARY HEAT-TREATMENT FURNACE, HEAT-TREATMENT APPARATUS, AND METHOD OF HEAT TREATMENT

TECHNICAL FIELD

The present invention relates to a hot air blowing type fluidized bed furnace, which treats the work piece with hot air directly blown into the vessel, and heat-treatment apparatus which uses the furnace. The present invention also relates to a rotary heat-treatment furnace and heat-treatment apparatus which uses the furnace, and method of heat treatment which also uses the furnace.

BACKGROUND ART

It is known that a metal will have an improved mechanical strength, when heat-treated to change its inner structure.

Multinary Al—Si-based alloys, which comprise an Al—Si-based Al alloy as the basic composition containing one or more elements, e.g., Cu or Mg, have been used for products required to have high mechanical strength, e.g., cast or expanded products of Al-based alloys for automobile members, e.g., those around the wheel, because of their favorable properties. For example, they have higher melt fluidity and fill the mold more smoothly than the other alloys, which are very important for the cast or expanded product. Moreover, they scarcely show cracking when cast, can have still improved strength or elongation when combined with another element, and are low in thermal expansion coefficient and high in resistance to wear.

The examples of Al—Si-based alloys incorporating a small quantity of Mg include AC4A, AC4C and AC4CH, wherein the heat treatment effect due to precipitation of the intermediate phase of $Mg_2Si$ increases their strength. In particular, AC4C and AC4CH whose Fe content is limited to 0.20% by weight or less to improve toughness are being used as the alloys for vehicle wheels, e.g., those for automobiles.

The Al alloys for expanded materials, e.g., 2000-series alloys containing Cu and 6000-series alloys containing Mg and Si, also have improved strength as a result of precipitation and hardening of the intermediate phase of $Mg_2Si$ or $Al_2Cu$.

As discussed above, taking an Al alloy as an example, it can have increased strength is brought by incorporation of another element and the resultant age-precipitation of the intermediate phase. The heat treatment for the age-precipitation comprises the solution treatment and aging treatment. The solution treatment is the heat treatment which dissolves, at an elevated temperature, the non-equilibrium phase precipitation out during the solidification step to form a solid solution, and cools it with water to form the solid solution uniform at normal temperature. The solution treatment is followed by the aging treatment, which keeps the solid solution at relatively low temperature, to precipitate the element out of the solid solution in which it is dissolved and harden it as the intermediate phase. These heat treatment steps improve mechanical properties of the Al alloy.

The solution and aging treatments of an Al alloy have been effected in atmosphere furnaces, e.g., tunnel furnace with air used as the heat medium. These furnaces have disadvantages which make the solution heat treatment difficult at higher temperature, e.g., slow heating rate and a wide temperature fluctuations of around ±5° C.

The solution heat treatment by the conventional atmosphere furnace takes a long time, a total of around 4 hours or more, to heat the work piece to the dissolution temperature, due to slow heating rate, and to hold it at that temperature for more than 3 hours. The conventional atmosphere furnace, e.g., tunnel furnace, needs a large heat-treatment facilities, which inevitably pushes up the initial investment cost, and also needs a large manpower for time-consuming works and a large quantity of heat energy for increasing and keeping temperature, which increases the running cost.

More recently, use of a fluidized-bed furnace is proposed for solution and aging heat treatment of an Al alloy, in Japanese Patent Laid-Open No. 2000-17413, which, however, describes no particular type of fluidized-bed furnace.

The known conventional fluidized-bed has a structure, e.g., shown in FIGS. 5(*a*), (*b*) or (*c*). The fluidized beds shown in FIGS. 5(*a*) and (*b*) are of the so-called indirect heating type, wherein cold air A is blown upward from the air chamber 52 below the distributor 50, passing through the fine holes 55 in the distributor 50 to fluidize the particles 54, e.g., sand, over the distributor 50. The fluidized bed vessel 58 shown in FIG. 5(*a*) is heated by the heating means 59, e.g., heating wires or gas provided around the external periphery, to heat the particles 54 and work piece put in the fluidized bed. The fluidized bed shown in FIG. 5(*b*) is provided with the radiant tube system 60 inside as the heating means, to heat the particles 54 and work piece put in the fluidized bed.

The above fluidized beds of indirect heating type has disadvantages, e.g., low heating efficiency and temperature distribution between the area around the heating means and other areas.

On the other hand, the fluidized bed shown in FIG. 5(*c*) is of direct heating type, wherein hot air B is blown upward through the fine holes 55 in the distributor 50, to fluidize the particles 54 and thereby to form the fluidized bed, and, at the same time, to heat the particles 54 and work piece put in the fluidized bed. The fluidized bed directly heated with hot air has an advantage of good temperature distribution within the bed. The conventional fluidized bed needs baffles 56 over the fine holes 55, as shown in FIG. 6, to prevent the particles 54 from falling through the fine holes 55. It also needs the air chamber below the distributor, which tends to increase its size. Its another disadvantage is that the distributor must have an additional strength to support weight of the particles, e.g., sand, which further increases facility size and investment cost.

It is an object of the invention to provide a hot air blowing type fluidized-bed furnace which can solve the problems involved in the conventional fluidized bed. It needs a lower investment cost and smaller space and prevents thermal energy loss, and suitable for a heat treatment furnace for metals, e.g., Al alloy.

It is another object of the invention to provide a heat-treatment furnace and heat-treatment apparatus which are compact and hence need reduced investment cost and space, and, at the same time, thoroughly prevent thermal energy loss and are capable of being fully automatically operated, to reduce the running cost. It is still another object of the present invention to provide a method of heat treatment.

DISCLOSURE OF THE INVENTION

The present invention provides a fluidized-bed furnace, in which the work piece is heat-treated in a fluidized bed of particles put in the vessel, fluidized by hot air blown into the vessel. It includes a cantilevered dispersion tube extended into the fluidized bed, and provided with air outlets directed downward, from which the hot air is blown out.

The dispersion tube for the present invention is composed of the pressure-regulating header, and a plurality of branch tubes branching off from the above header. Both pressure-regulating header and branch tubes are preferably disposed in the fluidized bed. The fluidized bed of the present invention is preferably provided with a drain mechanism at the bottom of the vessel, to drain condensed water off.

The present invention also provides a heat-treatment apparatus which incorporates the above-described fluidized-bed furnace as the solution and/or aging treatment furnaces, characterized in that it includes, in addition to the solution and aging treatment furnace, a heat-resistant dust collector and heat exchanger, the former for removing dust from the gases discharged from the solution treatment furnace and the latter for utilizing waste heat it recovers from the dust-removed discharged gases as the heat source for the aging treatment furnace.

The present invention also provides a rotary heat-treatment apparatus for heat-treatment of a metallic work piece, having a fluidized bed heated and fluidized by hot air blown via the hot air tube provided in the furnace, characterized in that the hot air tube is immersed in the fluidized bed in the furnace and that means for rotating the work piece, while it is heat-treated, is provided within the fluidized bed and above the hot air tube.

The means for rotating the work piece comprises a furnace floor which supports the work piece and rotates it in the fluidized bed, rotating axis disposed at the center of the furnace floor, and driver which rotates the furnace floor via the rotating axis, wherein the rotating axis is preferably separated from the fluidized bed by the cut-off wall. The means for rotating the work piece is of pitch feed type to move the furnace floor intermittently, preferably freely adjustable for feeding and stopping time.

The rotary heat-treatment furnace of the present invention is preferably provided with an introducing wall which connects the fluidized bed inside to the furnace outside at each of the inlet port through which the work piece is charged and outlet port through which the work piece is discharged. It is also preferably provided with an air curtain and/or dust collector at each of the inlet and outlet ports. Moreover, it is also preferable that the inlet port serves as the outlet port, and that a damper mechanism is provided at the port to prevent fluctuations of furnace pressure while the work piece is charged or discharged.

In the rotary heat-treatment furnace of the present invention, the hot air tube is composed of a header tube and dispersion tubes, the former being ring-shaped, and the latter being almost cylindrical and each provided with nozzles or small holes, wherein it is preferable that the dispersion tubes are located between the header tube and furnace floor in the vertical direction, and radiate in the horizontal direction from the ring center of the header tube. It is also preferable that the hot air outlet of the hot air tube is located below the opening of the work piece inlet or outlet port.

The rotary heat-treatment furnace of the present invention is preferably provided with a mechanism for automatically controlling temperature, which, for example, measures temperature in the furnace by a plurality of temperature-sensing instruments installed at the furnace corners, and, based on the measured temperature levels, changes gas flow rate to control temperature of hot air being blown into the furnace, thereby controlling temperature in the furnace.

The rotary heat-treatment furnace of the present invention is also preferably provided with a mechanism for automatically controlling fluidized bed interface level, which measures the interface level by at least one interface-sensing instrument installed at the furnace corner, and, based on the measured interface level, changes flow rate of the particles charged from the particle feeder provided at the top of the furnace to control the fluidized bed interface level.

The present invention also provides a heat-treatment apparatus which uses the above-described rotary heat-treatment furnace as the solution and/or aging treatment furnace, characterized in that it includes, in addition to the solution and aging treatment furnaces, at least a heat-resistant dust collector and heat exchanger, the former for removing dust from the gases discharged from the solution treatment furnace and the latter for utilizing waste heat it recovers from the dust-removed discharged gases as the heat source for the aging treatment furnace.

The heat-treatment apparatus of the present invention is preferably provided with an automatic carrier which charges and discharges the work piece in and from the rotary heat-treatment furnace. For example, a gantry is suitably used for the automatic carrier.

The present invention also provides a method of heat treatment, wherein a metallic work piece is heat-treated by solution treatment and then by aging treatment to improve its mechanical properties, characterized in that a hot air tube is immersed in the fluidized bed in the furnace; a rotary heat-treatment furnace equipped with means for rotating the work piece, while it is heat-treated, is provided within the fluidized bed and above the hot air tube for the solution and/or aging treatment; and the waste heat of the gases discharged from the solution treatment step is recovered by a heat exchanger as the heat source for the aging treatment.

The present invention can suitably treat a work piece, e.g., aluminum wheel.

BEST MODE FOR CARRYING OUT THE INVENTION

The present invention will be described in detail.

The present invention provides an improved fluidized-bed furnace, in which the work piece is heat-treated in a fluidized bed of particles put in the vessel, fluidized by hot air blown into the vessel. It is characterized in that it includes a cantilevered dispersion tube extended into the fluidized bed, provided with air outlets directed downward, from which the hot air is blown out.

As described above, the fluidized-bed furnace of the present invention uses the dispersion tube, extended into the fluidized bed, cantilevered, and provided with air outlets directed downward, from which the hot air is blown out. This design dispenses with an air chamber below the fluidized bed, which is needed by the conventional fluidized bed furnace provided with a porous plate (dispersion plate), and solves one of the disadvantages involved in the conventional furnace that the distributor must have an additional strength to support weight of the particles, e.g., sand, which further increases facility size and investment cost. The dispersion tube, being cantilevered, is prevented from cracking or the like caused by thermal expansion or contraction accompanying temperature increase or decrease within the fluidized-bed furnace.

The present invention incorporates the fluidized bed in which hot air is directly blown into the fluidized bed.

The fluidized bed is formed while being uniformly mixed, because the particles, e.g., sand, put in the vessel are heated and fluidized by hot air blown into the vessel, with the result that it is characterized by almost uniform temperature throughout the fluidized bed inside and high heat transfer efficiency.

The furnace of the present invention, which incorporates the fluidized bed of the above-described characteristics, includes the dispersion tube which disperses hot air in the fluidized bed, the dispersion tube being characterized by a cantilevered structure and provided with air outlets directed downward.

Now, the hot air blowing type fluidized bed furnace of the present invention will be described further by referring to the attached drawings.

Figure 1:
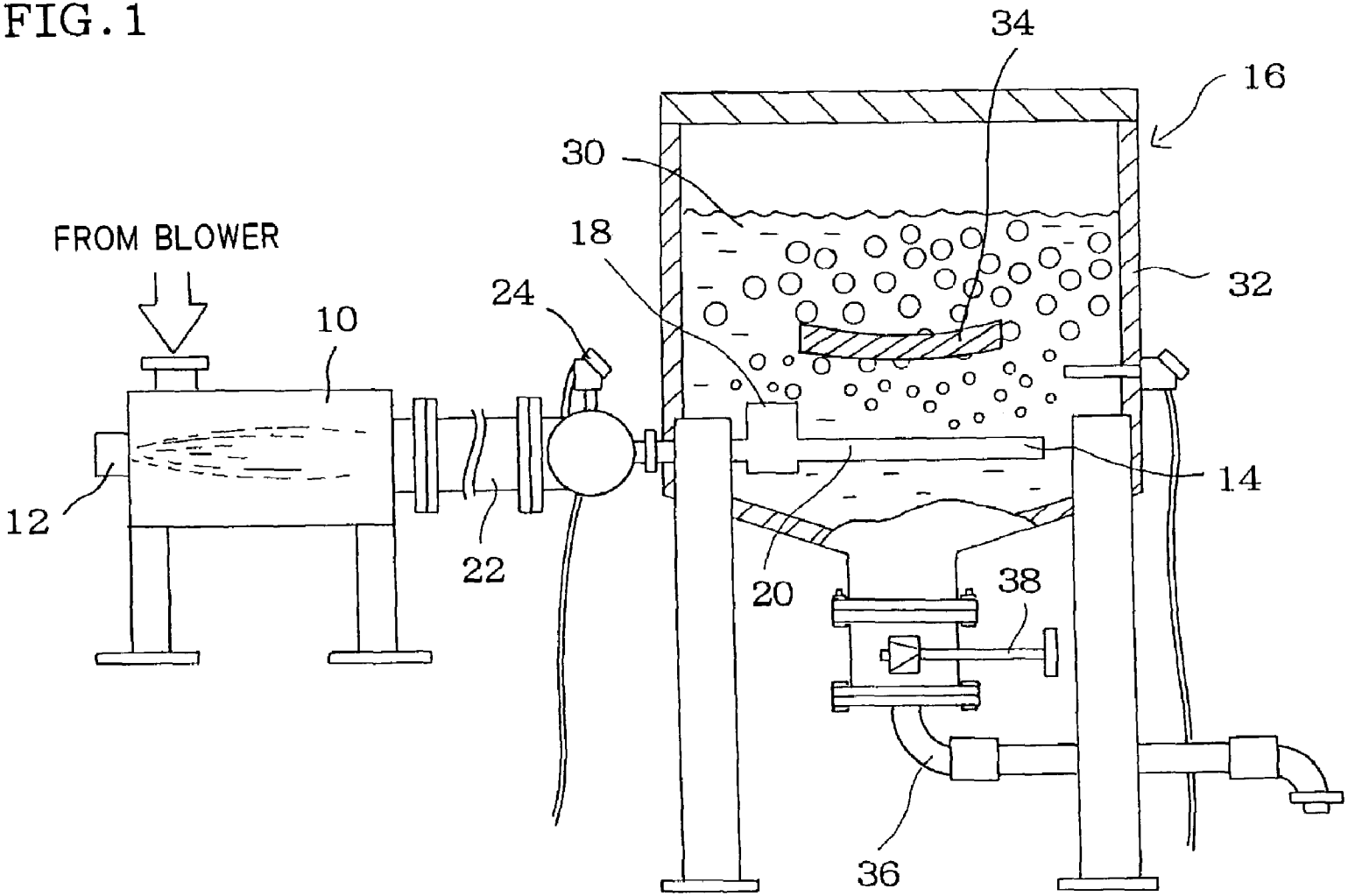
FIG. 1 shows schematically one embodiment of the hot air blowing type fluidized bed furnace of the present invention.
Figure 2:
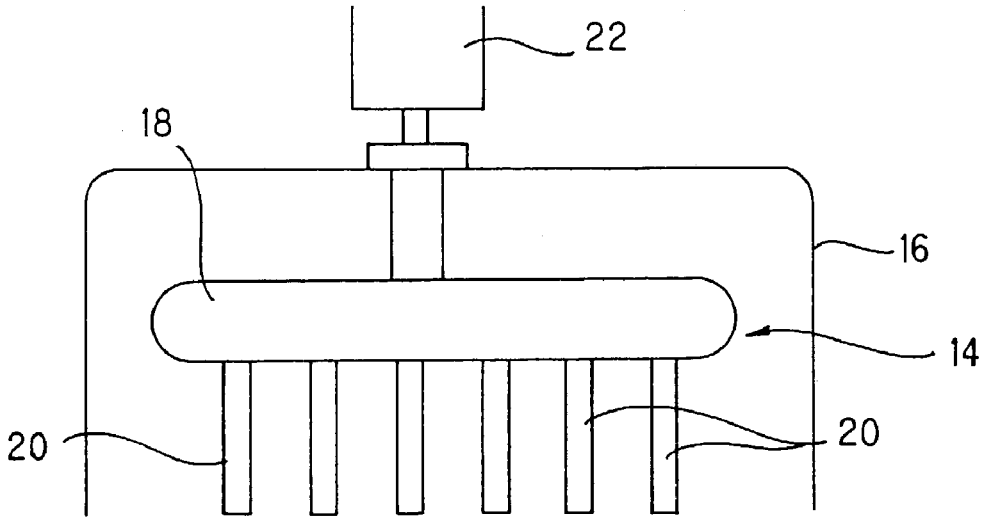
FIG. 2 shows schematically a plan view of the hot air blowing type fluidized bed furnace, illustrated in FIG. 1.
Figure 3:
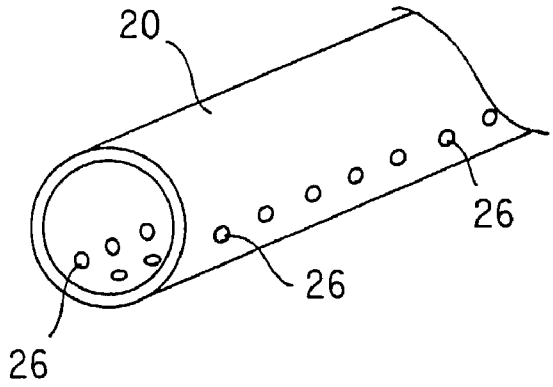
FIG. 3 presents a perspective view of the branch tube.

FIG. 1 shows schematically one embodiment of the hot air blowing type fluidized bed furnace of the present invention, and FIG. 2 shows the plan view of the furnace illustrated in FIG. 1. Referring to FIGS. 1 and 2, the hot air generator 10 heats air sent from a blower (not shown) by the flame from the burner 12 to a given temperature, e.g., 700 to 800° C. The hot air is blown into the fluidized-bed furnace 16, composed of the vessel 32 containing the particles 30, via the tube 22 and hot wind temperature monitor 24. The fluidized-bed furnace includes the hot air dispersion tube 14, which is cantilevered and composed of the pressure-regulating header 18 and a plurality of branch tubes 20 branching off from the header 18. The branch tube 20 is provided with a number of air outlets 26 open downward, as shown in FIG. 3.

As described above, it is essential that the dispersion tube 14 for the present invention is cantilevered. The dispersion tube 14 of heat-resistant steel or the like will thermally expand in the fluidized bed 16 kept at high temperature, e.g., 540 to 550° C. If the dispersion tube 14 were supported at both ends, it would be structured in such a way to absorb the thermal expansion of the dispersion tube 14, which could crack or even fracture the tube 14 itself. The dispersion tube 14 for the present invention is cantilevered, to avoid cracking or other damages of the tube by the thermal expansion at high temperature.

The dispersion tube 14 is composed of the pressure-regulating header 18 and a plurality of branch tubes 20 branching off from the header 18, both disposed in the fluidized bed 16.

Figures 5A, 5B, 5C:
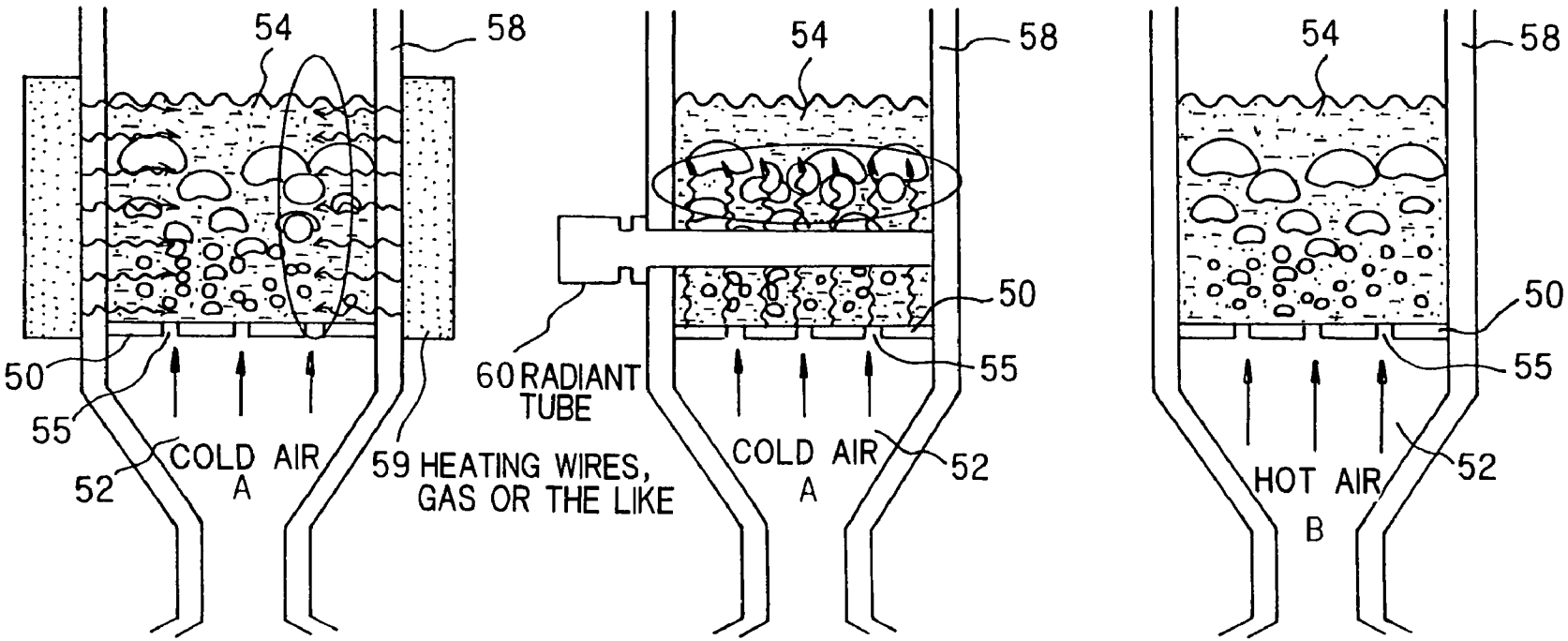
FIG.5(a) PRIOR ART
FIG.5(b) PRIOR ART
FIG.5(c) PRIOR ART
FIGS. 5(*a*), (*b*) and (*c*) are cross-sectional views illustrating the conventional fluidized beds; (a): indirect heating type fluidized bed, wherein the vessel is heated, (b): indirect heating type fluidized bed, heated by a radiant tube system, and (c): fluidized bed heated by hot air blown through a porous plate.
Figure 6:
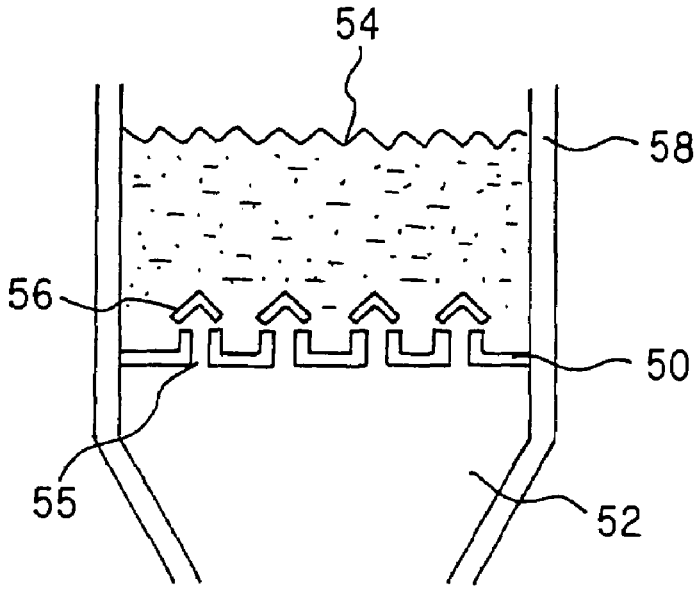
FIG.6 PRIOR ART
FIG. 6 is a cross-sectional view illustrating the fluidized bed with baffles over the porous plate.

As described above, the dispersion tube 14 of the present invention is composed of the pressure-regulating header 18 and a plurality of branch tubes 20 branching off from the header 18, both disposed in the fluidized bed 16 formed in the vessel 32. This design dispenses with an air chamber below the fluidized bed, unlike the conventional fluidized bed shown in FIGS. 5(*a*), (*b*) or (*c*) or FIG. 6, and makes the vessel smaller. It is true that the cantilevered dispersion tube 14 is mechanically weak against bending stress, but it will not be broken because it is supported by the fluidized bed of particles 30 below.

In the hot air blowing type fluidized-bed furnace of the present invention, hot air is first sent to the pressure-regulating header 18, where it is held for a while, and blown into the fluidized bed 16 from the a plurality of branch tubes 20 at almost the same pressure, to fluidize and heat the particles 30. The fluidized bed 16 inside is heated, e.g., at 540 to 550° C. for solution treatment of an Al alloy work piece. The fluidized bed is uniformly heated, with furnace inside temperature fluctuations of around 6° C. (±3° C.) and around 3° C. (±1.5° C.) at any point, to rapidly heat the work piece 34 in the fluidized-bed furnace 16. The particles 30 is discharged out of the furnace, as required, via the particle discharge valve 36.

In the hot air blowing type fluidized-bed furnace of the present invention, the vessel 32 containing the fluidized be is preferably provided with a drain mechanism 38 at the bottom. The hot air for fluidizing the particles contains steam, which may be condensed to pile up at the vessel 32 bottom. It is drained off by the drain mechanism 38.

Figure 4:
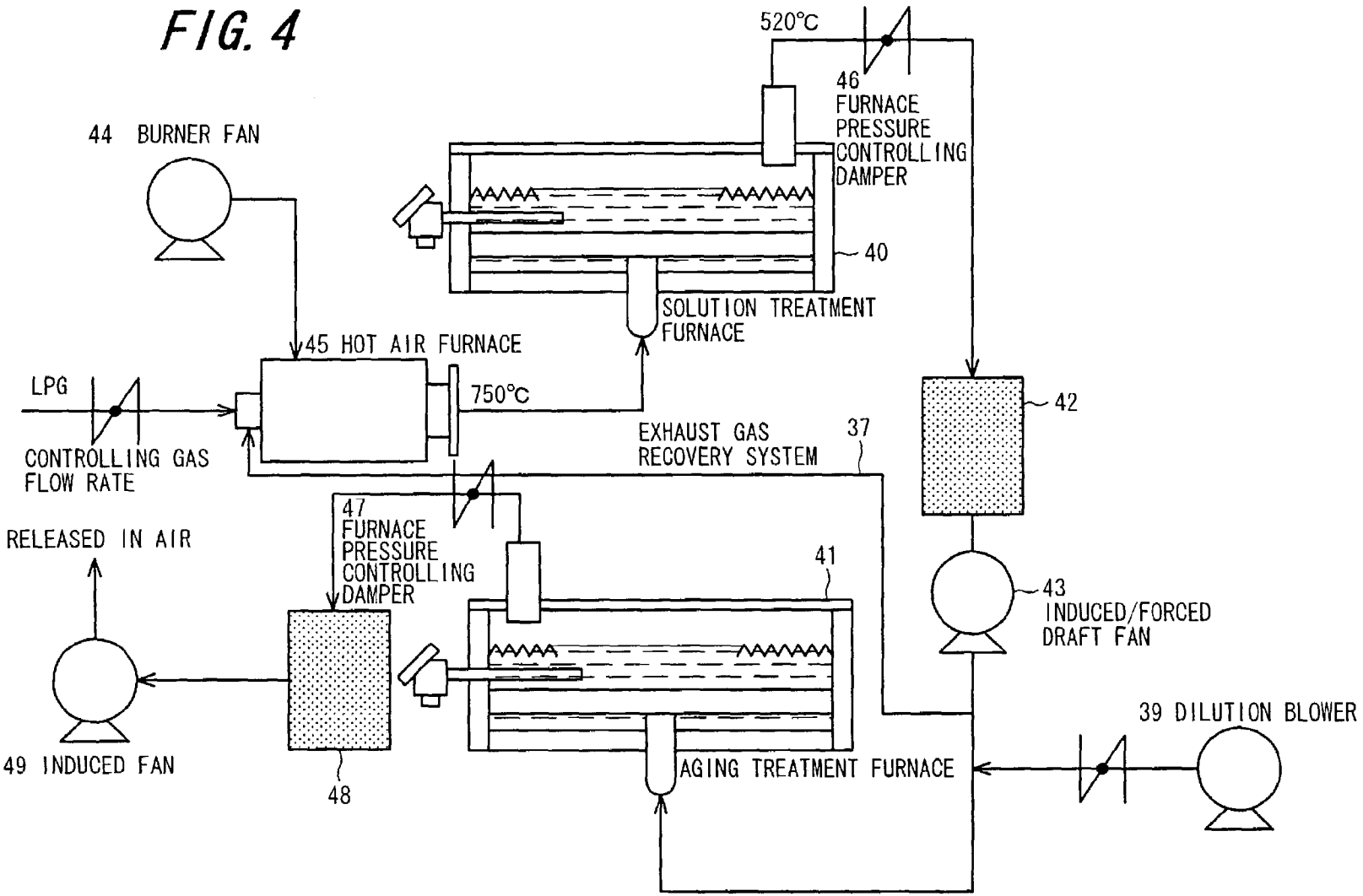
FIG. 4 shows one embodiment of the heat-treatment apparatus which incorporates the fluidized-bed furnace of the present invention.

Next, the heat-treatment apparatus which incorporates the hot air blowing type fluidized-bed furnace of the present invention is described by referring to FIG. 4.

FIG. 4 shows one embodiment of the heat-treatment apparatus which incorporates the fluidized-bed furnace of the present invention, which is used as the solution treatment furnace 40 and/or aging treatment furnace 41. This heat-treatment apparatus comprises the solution treatment furnace 40 and aging treatment furnace 41, each composed of a fluidized-bed furnace, and heat-resistant dust collector 42 and forced/induced draft fan 43 in the piping system that connects the solution treatment furnace 40 and aging treatment furnace 41 to each other.

A fuel gas, e.g., LPG, is burnt in the hot air furnace 45 after being mixed with air sent from the burner fan 44, to generate the hot air of around 750° C. The hot air is introduced into the solution treatment furnace 40 composed of a fluidized bed, to fluidize and heat the particles for solution treatment of the work piece of Al alloy, discharged from the solution treatment furnace 40 while being kept at around 520° C. via the furnace pressure regulating damper 46, and passed through the heat-resistant dust collector 42 (e.g., Pyroscreen™) while being kept hot, to remove the dust. The dust-free exhaust gases are then introduced, via the heat-resistant forced/induced draft fan 43, into the aging treatment furnace 41, where it is reused as the heat source and fluidizing gas for the aging treatment furnace 41. The gases discharged from the aging treatment furnace 41 are passed through the heat-resistant dust collector 48 via the furnace pressure regulating damper 47 to remove the dust, and released in air via the induced draft fan 49.

The gases discharged from the heat-resistant dust collector 42 can be partly recycled, via the tube 37, by the induced/forced draft fan 43 to the hot air furnace 45. The dilution blower 39 sends dilution air to control temperature of the exhaust gases passed from the heat-resistant dust collector 42 into the aging treatment furnace 41 via the induced/forced draft fan 43. However, it is preferable to control temperature of the exhaust gases by a heat exchanger (not shown) installed upstream of the heat-resistant dust collector 42, in consideration of easiness of temperature control, dust collector capacity and operational stability for extended periods.

The above-described heat-treatment apparatus can reuse the heat energy of hot air discharged from the solution treatment furnace 40 for the downstream aging treatment furnace 41, for effective utilization of the heat energy.

Next, the rotary heat-treatment furnace of the present invention, heat-treatment apparatus which incorporates the rotary heat-treatment furnace, and method of heat treatment which uses the heat-treatment apparatus are described in detail.

The heat-treatment apparatus thermally treats a work piece rotating in a circle in the furnace, characterized in that the compact rotary heat-treatment furnace containing the fluidized bed is used as the solution and/or aging treatment furnace. The fluidized bed inside is kept at almost the same temperature and efficiently transfers heat. As such, it can heat the work piece to the solution treatment temperature in a shorter time. Moreover, the heat-treatment apparatus is sufficiently compact to reduce the fabrication costs of the heat-treatment furnace itself and the associated facilities, e.g., connecting piping system, frame, support and work piece carrier members and peripheral equipment. It can also reduce the necessary plot area (and hence land cost), and the installation cost, including the transportation cost.

The heat-treatment apparatus is also characterized in that waste heat of the exhaust gases from the solution treatment furnace is recovered and reused as the heat source for the aging treatment furnace. Given that the solution treatment temperature is normally around 550° C. whereas the aging treatment temperature is around 180° C., the waste heat of the exhaust gases from the solution treatment furnace can provide sufficient heat for the aging treatment, even when taking into consideration heat recovery rate at the heat exchanger. Therefore, reuse of the waste heat can reduce running cost by the heating cost for the aging treatment furnace.

Reuse of the waste heat can also reduce the investment cost, because it dispenses with the hot wind generation unit for the aging treatment, e.g., hot wind furnace, although the additional facility of heat exchanger is needed.

The heat-treatment apparatus of the present invention is also characterized by automatic charging/discharging of work pieces and temperature or interface level control within the fluidized bed, to realize the stable heat treatment by only limited manpower.

Figure 12:
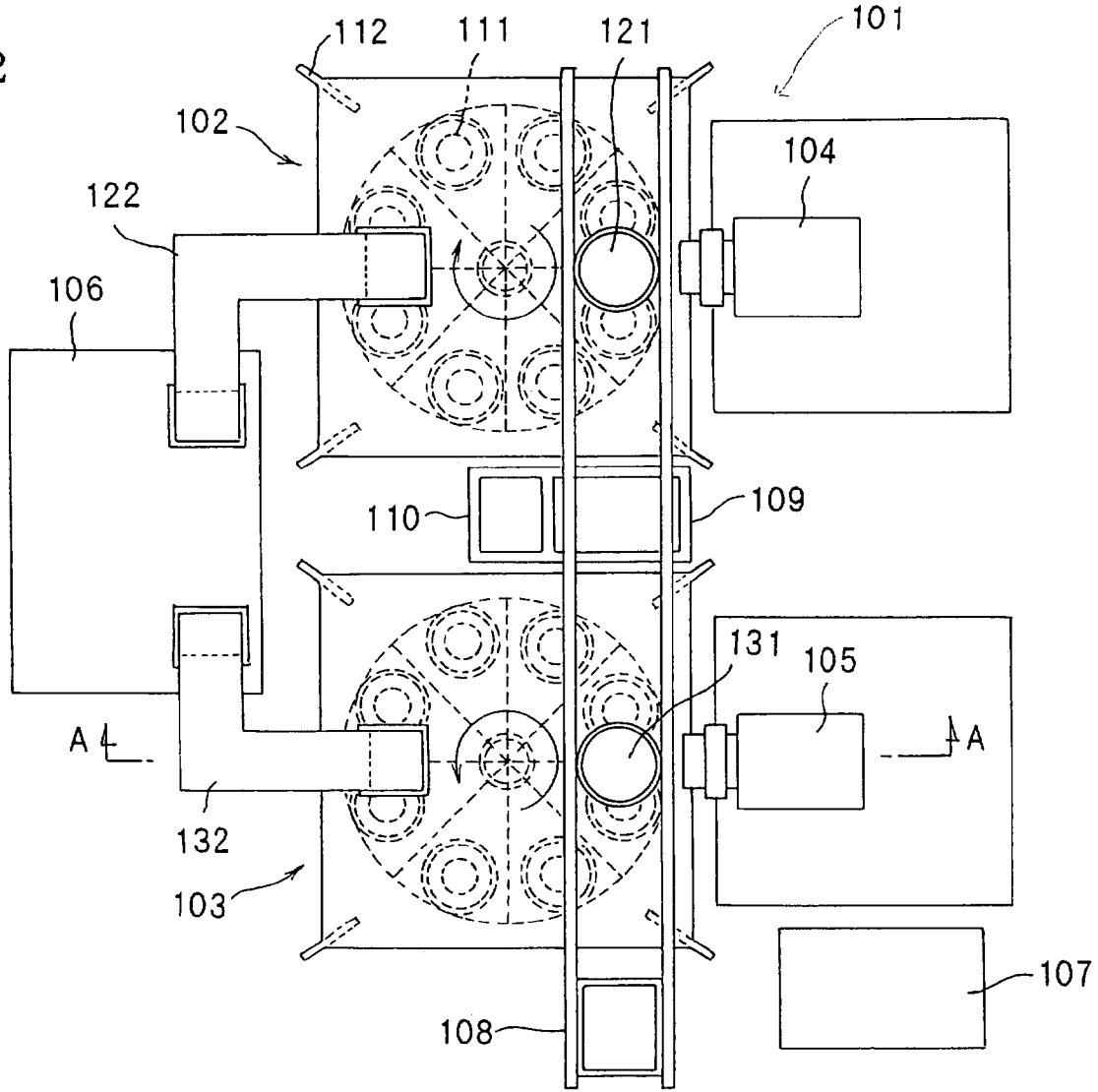
FIG. 12 is a plan view of another embodiment of the heat-treatment apparatus of the present invention.

FIG. 12 is a plan view of one embodiment of the heat-treatment apparatus which incorporates the rotary heat-treatment furnace of the present invention. The heat-treatment apparatus 101 includes the solution treatment furnace 102, aging treatment furnace 103, heat-resistant dust collector 106, heat exchanger 107, automatic carrier 108 and hot air generator 104, 105 as the major components. The hot air generator 105 for the aging treatment furnace 103 is not an essential component, as described above, but is provided in this embodiment as the backup.

The work piece 111 is treated in the following flow. It is first charged by the automatic carrier 108 into the solution treatment furnace 102 from the inlet port 121, where it is solution-treated at high temperature. The solution-treated work piece is discharged from the inlet port 121, and sent by the carrier 108 to the tempering water tank 109, where it is immersed in water to be rapidly quenched to room temperature. Then, it is charged by the automatic carrier 108 to the aging treatment furnace 103 from the inlet port 131, where it is aging-treated at medium to low temperature. The aging-treated work piece is discharged from the inlet port 131, and sent back to the original position.

The automatic carrier is not limited, and a gantry, for example, may be used. The automatic carrier 108 shown in FIG. 12 has a handle running on two rails while holding the work piece, to charge or discharge the work piece in or out of the solution treatment furnace 102, tempering water tank 109 or aging treatment furnace 103 by the aid of a lift (not shown). For the layout of the solution treatment furnace 102, tempering water tank 109 and aging treatment furnace 103, it is preferable to arrange the inlet port 121, water tank 109 and inlet port 131 in a straight line in the treatment order, as shown in FIG. 12, for reducing cost and transfer time.

The rotary heat-treatment furnace, described later, is used as the solution treatment furnace 102. The work piece 111 is charged from the inlet port 121 into the fluidized bed, where it is solution-treated.

When the work piece 111 is of an Al alloy to be used for a vehicle wheel, it is treated by the following procedure.

It is rapidly heated to the solution treatment temperature within 30 minutes. This reduces the overall solution treatment time, and, at the same time, prevents excessive growth of the eutectic structure and keeps it spherical. Therefore, it can improve ductility (elongation-related properties) as well as strength of the work piece. It is preferably heated to the solution treatment temperature within 20 minutes, more preferably 3 to 10 minutes. The heating time exceeding 30 minutes may excessively grow the eutectic structure of the Al alloy, and hence is undesirable. The solution treatment is effected at 535 to 550° C., preferably 540 to 550° C.

A fluidized bed for the heat treatment has the following advantages over the conventional atmosphere furnace with air as the heat medium.

The particles are heated by hot wind in a fluidized bed, where they are mixed uniformly with each other, to keep the fluidized bed inside temperature generally uniform (within around ±2 to 3° C.) and high heat transfer efficiency. As a result, heating time to the solution treatment temperature can be reduced. It is preferable that the work piece is held at the solution treatment temperature for 25 minutes to 3 hours. The treated Al alloy may have an insufficient ductility when held for less than 25 minutes, and also have an insufficient ductility when held for more than 3 hours, due to excessive growth of the eutectic structure of the alloy.

The rotary heat-treatment furnace is used also as the aging treatment furnace 103. The work piece 111 is charged from the inlet port 131 into the fluidized bed, where it is aging-treated. Use of the fluidized bed reduces the heating time and hence overall aging treatment time. When the work piece 111 is of an Al alloy to be used for a vehicle wheel, as is the case with the solution treatment, it is preferably heated to the aging treatment temperature of 160 to 200° C., more preferably 170 to 190° C., within several minutes, and held at that temperature for several tens minutes to several hours.

The heat-resistant dust collector 106 treats the exhaust gases from the solution treatment furnace 102 and aging treatment furnace 103 while they are kept hot, to remove dust therefrom. The exhaust gases from the solution treatment furnace 102, after passing through the heat-resistant dust collector 106, is sent via a piping system not shown to the heat exchanger 107 to recover the heat, and released into air. The hot air further heated by the heat exchanger 107 is sent, via a blower and piping system not shown, to the aging treatment furnace 103, where it serves as the heat medium. This design dispenses with energy for generating hot air, greatly reducing the running cost. The hot air generator 104 for the solution treatment furnace 102 is normally in service, whereas the hot air generator 105 for the aging treatment furnace 103 is the backup normally out of service and hence may be omitted.

The exhaust gases discharged from the solution treatment furnace 102 may be directly blown into the aging treatment furnace 103, after being treated to remove dust. This design is more efficient in recovery of heat, and can dispense with the heat exchanger 107 to reduce the investment cost. However, it is preferable to have the heat exchanger 107 to heat fresh air, in consideration of capacity and long-term operational stability of the heat-resistant dust collector 106, and easiness of temperature control.

Figure 13:
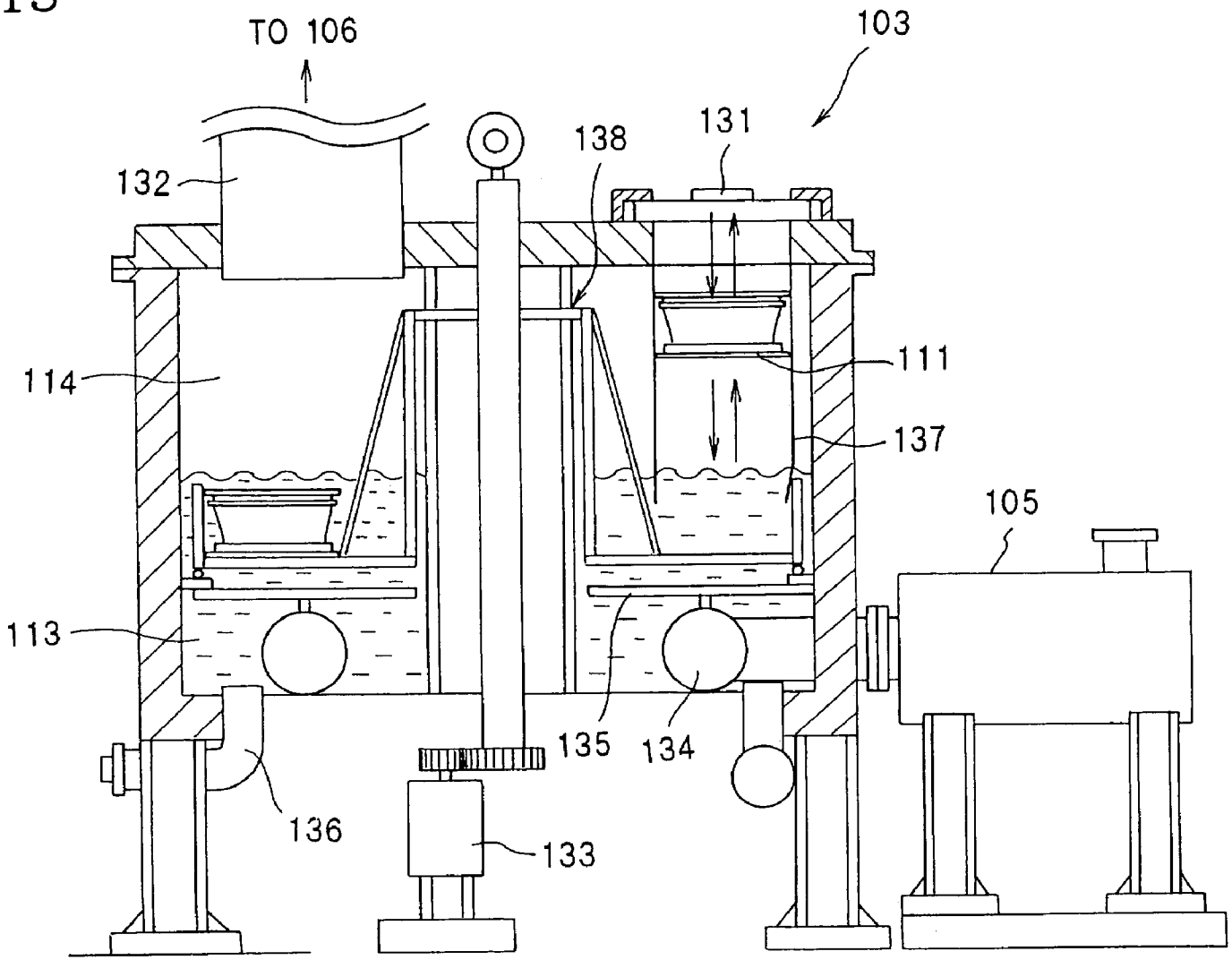
FIG. 13 shows one embodiment of the rotary heat-treatment furnace of the present invention, which is the A—A cross-section of the furnace shown in FIG. 12.
Figure 14:
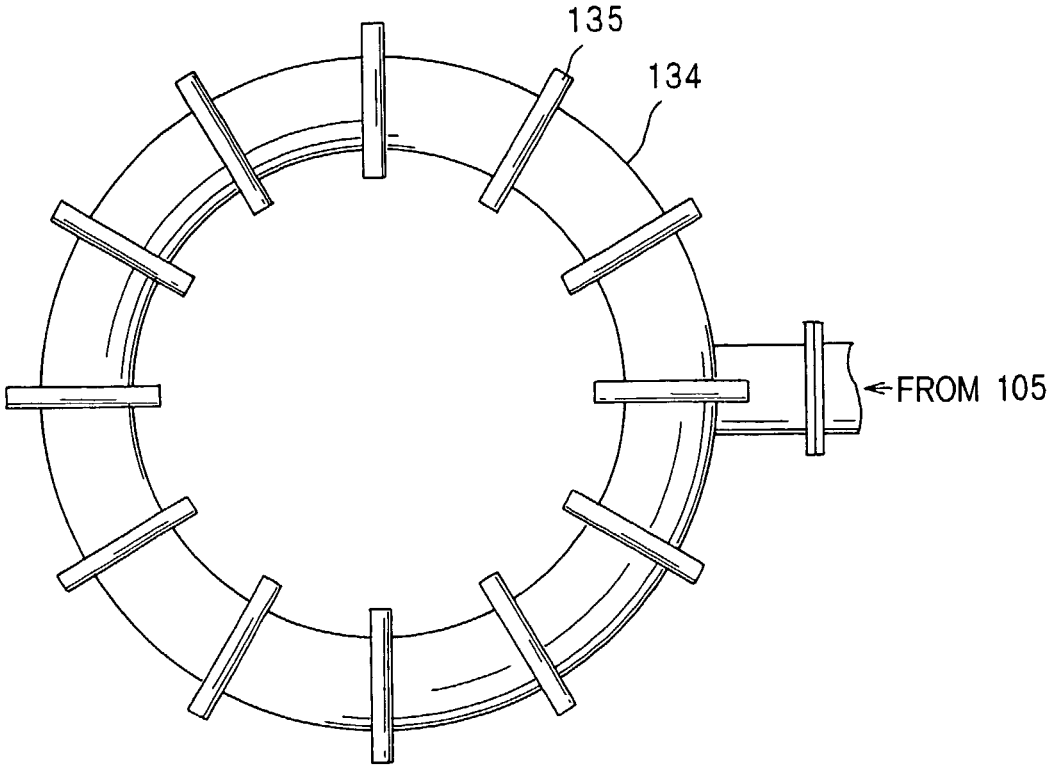
FIG. 14 is a plan view of the hot air tube in one embodiment of the rotary heat-treatment furnace of the present invention.

Next, the rotary heat-treatment furnace to be used for the solution treatment furnace 102 and aging treatment furnace 103 is described by referring to FIGS. 13 and 14.

FIG. 13 shows one embodiment of the rotary heat-treatment furnace of the present invention, which is the A—A cross-section of the furnace shown in FIG. 12. It is used for the aging treatment furnace 103, but structurally the same as that for the solution treatment furnace 102. The rotary heat-treatment furnace is described as the one for the aging treatment furnace 103. FIG. 14 is a plan view of the hot air tube installed in the rotary heat-treatment furnace.

The rotary heat-treatment furnace (serving as the aging treatment furnace 103) contains the fluidized bed 113 and atmosphere bed 114, with the hot air tube composed of the header tube 134 and dispersion tubes 135 immersed in the fluidized bed 113 in the furnace, wherein the work piece 111 is rotated in the fluidized bed 113 and above the dispersion tubes 135 to be heat-treated. The means for rotating the work piece comprises a furnace floor which supports the work piece 111 and rotates in the fluidized bed 113, rotating axis disposed at the center of the furnace floor, and driver 133 which rotates the furnace floor via the rotating axis. The furnace can treat the work piece 111 in a smaller space, when it is rotated, to reduce the cost. The means for rotating the work piece is of pitch feed type to move the furnace floor intermittently, preferably freely adjustable for feeding and stopping time, and hence total heat treatment time.

The particles are charged in the furnace in such a way to bury the hot air tube composed of the header 134 and dispersion tubes 135, and fluidized by and well mixed with hot air blown from the dispersion tubes 135, to form the fluidized bed 113 in which the work piece is heat-treated. The hot air generator 105 heats air sent from a blower (not shown) by the flame, and the hot air controlled at a given temperature is blown into the fluidized-bed furnace 113, via the hot air tube composed of the header tube 134 and dispersion tubes 135. The particle discharge port (drain) 136 is the port equipped with a valve (not shown), to discharge the particles as required.

It is known that a fluidized bed may be heated by heating the vessel in which it is formed, indirect heating or direct heating. Each of these is applicable, but the direct heating method with hot air directly blown to form the fluidized bed is more preferable for better temperature distribution within the bed.

In the rotary heat-treatment furnace of the present invention, the rotating axis which drives the furnace floor to rotate is separated from the hot fluidized bed 113 by a cut-off wall, to prevent the particles constituting the fluidized bed 113 from getting into the bearing for the rotating axis and other troubles, for stable operation for extended periods. The rotating axis is connected to the furnace floor via the cut-off wall, while being protected by the seal section 138. The rotating axis portion separated from the fluidized bed is kept at a higher pressure than the furnace inside by air from a compressor, to prevent the particles from getting into the portion.

The inlet port 131 through which the work piece 111 is put into the rotary heat-treatment furnace, also serves as the outlet port through which the work piece is discharged, to reduce number of openings and thereby to reduce heat loss. The inlet port 131 is provided with the introduction wall 137 which connects the furnace outside to the fluidized bed 113 inside, also to reduce heat released out of the atmosphere bed 114. The heat-treatment apparatus tries to save energy by reusing the waste heat of the exhaust gases discharged from the solution treatment furnace for the aging treatment furnace, and the heat-treatment furnace itself tries to save energy.

The inlet port 131 is preferably provided with an air curtain or dust collector, not shown, to prevent dust from getting into the furnace through the opening. It is also preferably provided with a damper mechanism to prevent fluctuations of furnace pressure while the work piece is charged or discharged.

The header tube 134 of the hot air tube is formed ring-shaped in line with rotation of the furnace floor which supports the work piece 111. The dispersion tubes 135 are located between the header tube 134 and furnace floor in the vertical direction, and radiate in the horizontal direction from the ring center of the header tube 134, each being almost cylindrical and provided with nozzles or small holes to blow the hot air into the fluidized bed. The hot air inlet of the dispersion tube is located below the inlet port 131, to control temperature drop while the inlet port is opened for charging or discharging the work piece, and thereby to allow the heat treatment to proceed stably.

The rotary heat-treatment furnace of the present invention is preferably provided with a mechanism for automatically controlling temperature to save manpower. For example, the mechanism measures temperature in the furnace by 4 temperature-sensing instruments installed at the furnace corners, when the furnace has a square cross-section, as shown in FIG. 12, and, based on the measured temperature levels, changes gas flow rate to control temperature of hot air being blown into the furnace.

The rotary heat-treatment furnace of the present invention is also preferably provided with a mechanism for automatically controlling fluidized bed interface level. For example, the mechanism measures the interface level by an interface-sensing instrument installed at one furnace corner, when the furnace has a square cross-section, as shown in FIG. 12, and, based on the measured interface level, charges particles from the particle feeder provided at the top of the furnace to control the fluidized bed interface level. One concrete example of the interface-sensing instrument determines the interface level of the particles that constitute the fluidized bed through transparent, heat-resistant glass by a photoelectric tube.

The present invention is described more concretely by EXAMPLE and COMPARATIVE EXAMPLE.

EXAMPLE

A work piece of Al alloy was solution-treated by a hot air blowing type fluidized bed furnace, shown in FIGS. 1 and 2, and aging-treated by an atmosphere furnace.

The fluidized-bed furnace for the solution treatment comprised a vessel in the form of square tank, 1500 by 1500 mm in area and 1800 mm in height of the straight body section, supported by a trapezoidal vessel for the fluidized bed. The aging treatment was effected by the conventional tunnel furnace (atmosphere furnace). Sand was used as the particles, 50 to 500 μm in average size.

Figure 11:
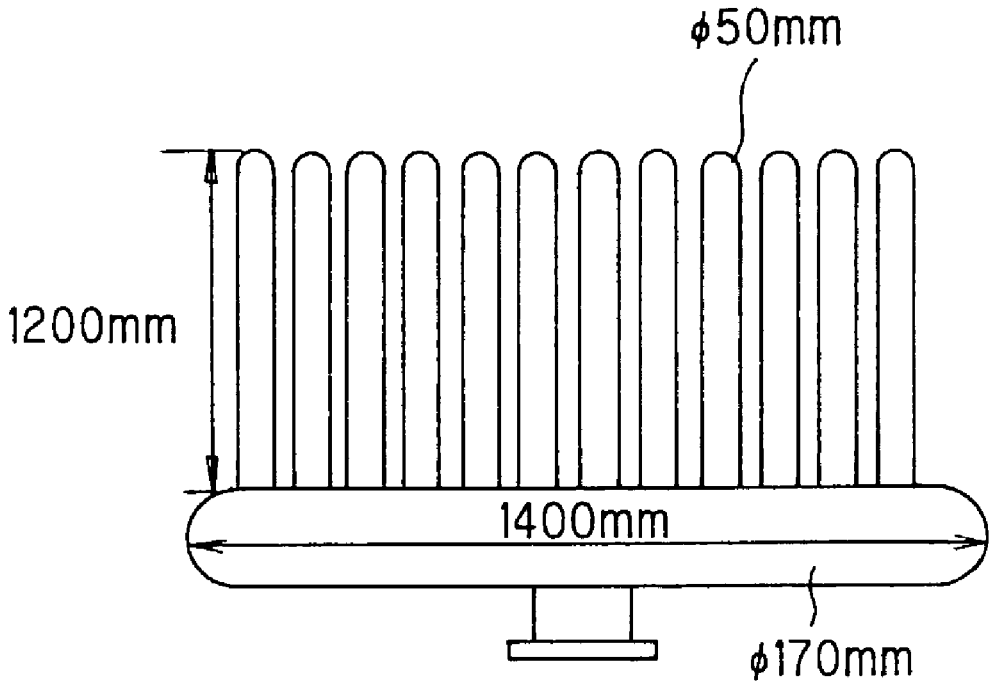
FIG. 11 is a plan view of the dispersion tube used in one embodiment.

The dispersion tube for hot air, to be placed in the fluidized bed, was cantilevered as shown in FIG. 11, with a pressure-regulating header 170 mm in diameter and 1400 mm in length and 12 branch tubes 50 mm in diameter and 1200 mm in length.

A cast vehicle wheel weighing 14 kg was heat-treated for the solution and aging treatment, and two types of test pieces were cut off from the outer rim flange and spoke of the wheel. The aluminum wheel composition was Si: 7.0%, Mg: 0.34%, Sr: 50 ppm and Al: balance, all by weight.

Figure 7:
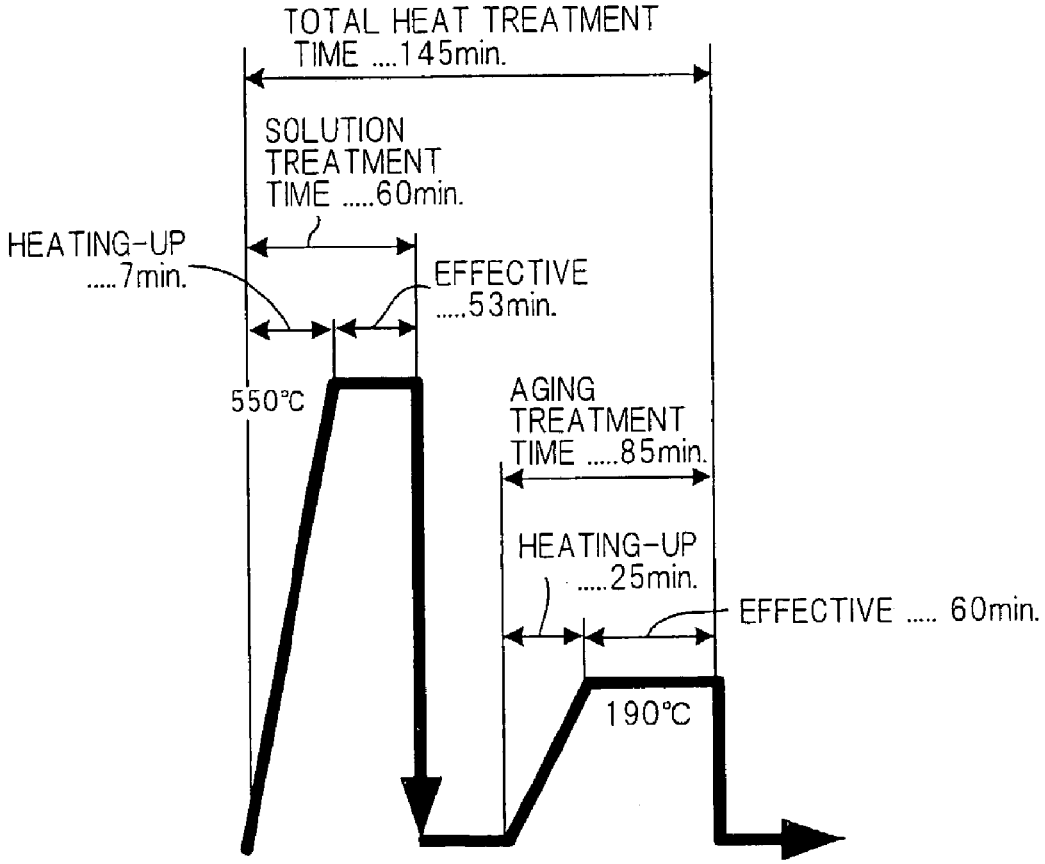
FIG. 7 is a graph showing the heat-treatment schedule in one embodiment.

The heat treatment temperature was 550° C. for the solution treatment and 190° C. for the aging treatment. FIG. 7 presents the heat-treatment schedules, i.e., time for heating the work piece to the solution treatment temperature, time for which it was held at the solution treatment temperature, time for heating the work piece to the aging treatment temperature, and time for which it was held at the aging treatment temperature.

Figure 8:
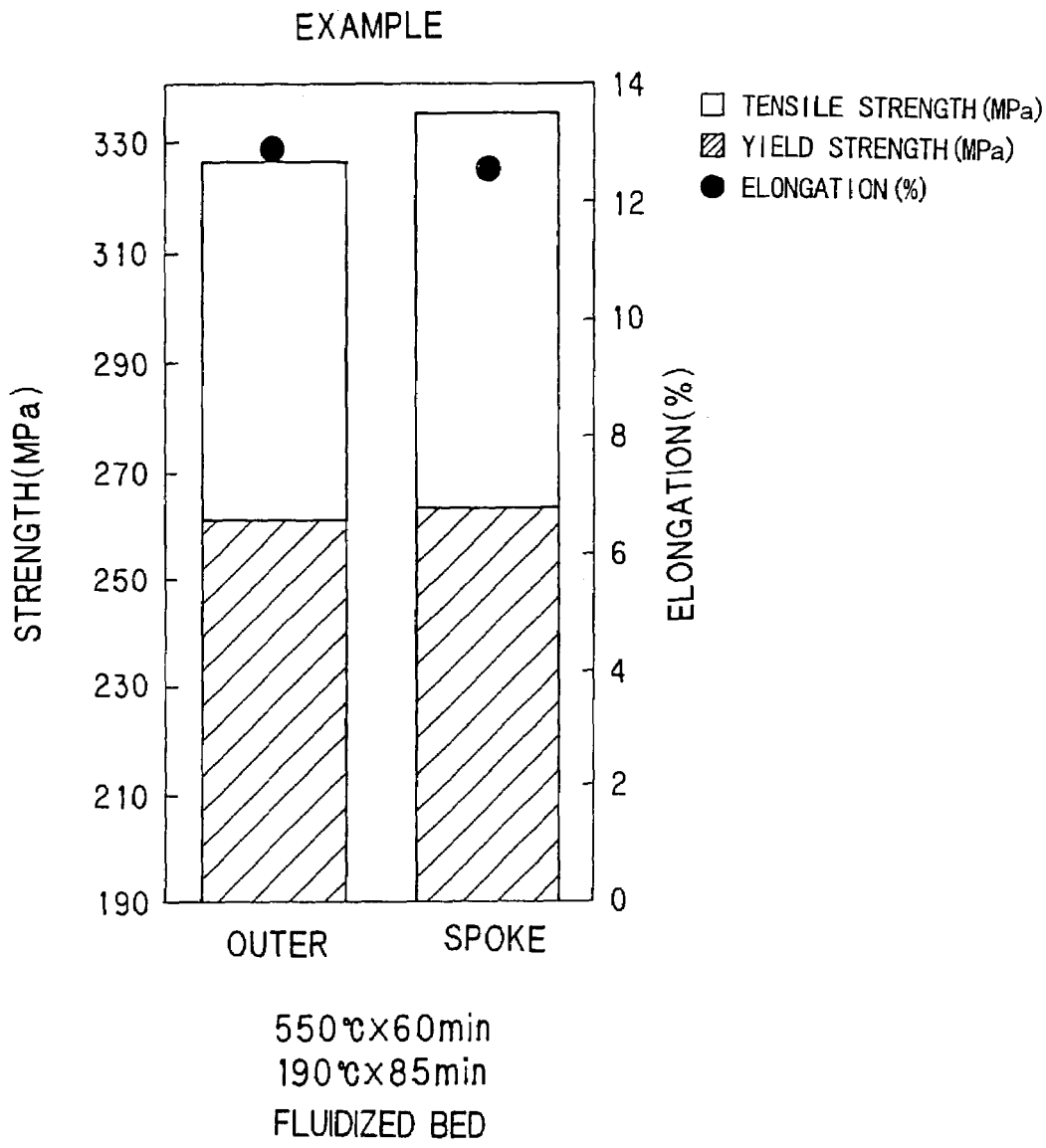
FIG. 8 is a graph showing the tensile test results in one embodiment.

The test pieces (n=4) were cut off from the heat-treated vehicle aluminum wheel, and tested for the tensile properties (tensile strength, 0.2% proof stress and elongation). The results are given in FIG. 8.

Comparative Example

Figure 9:
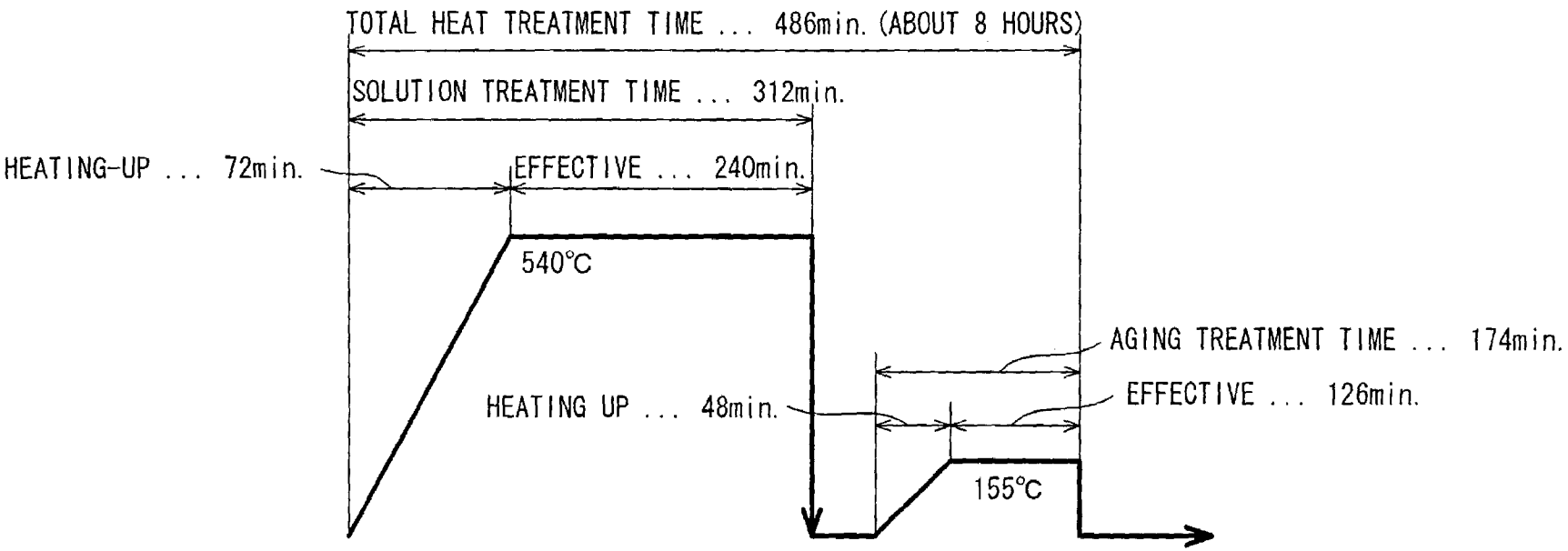
FIG. 9 is a graph showing the heat-treatment schedule for one comparative example.

The cast vehicle aluminum wheel was heat-treated under the same conditions as those used in EXAMPLE, except that the conventional tunnel furnace (atmosphere furnace) was used for both solution and aging treatment, the work piece was heated at 540° C. for the solution treatment and 155° C. for the aging treatment, and the heat treatment schedules given in FIG. 9 were used.

Figure 10:
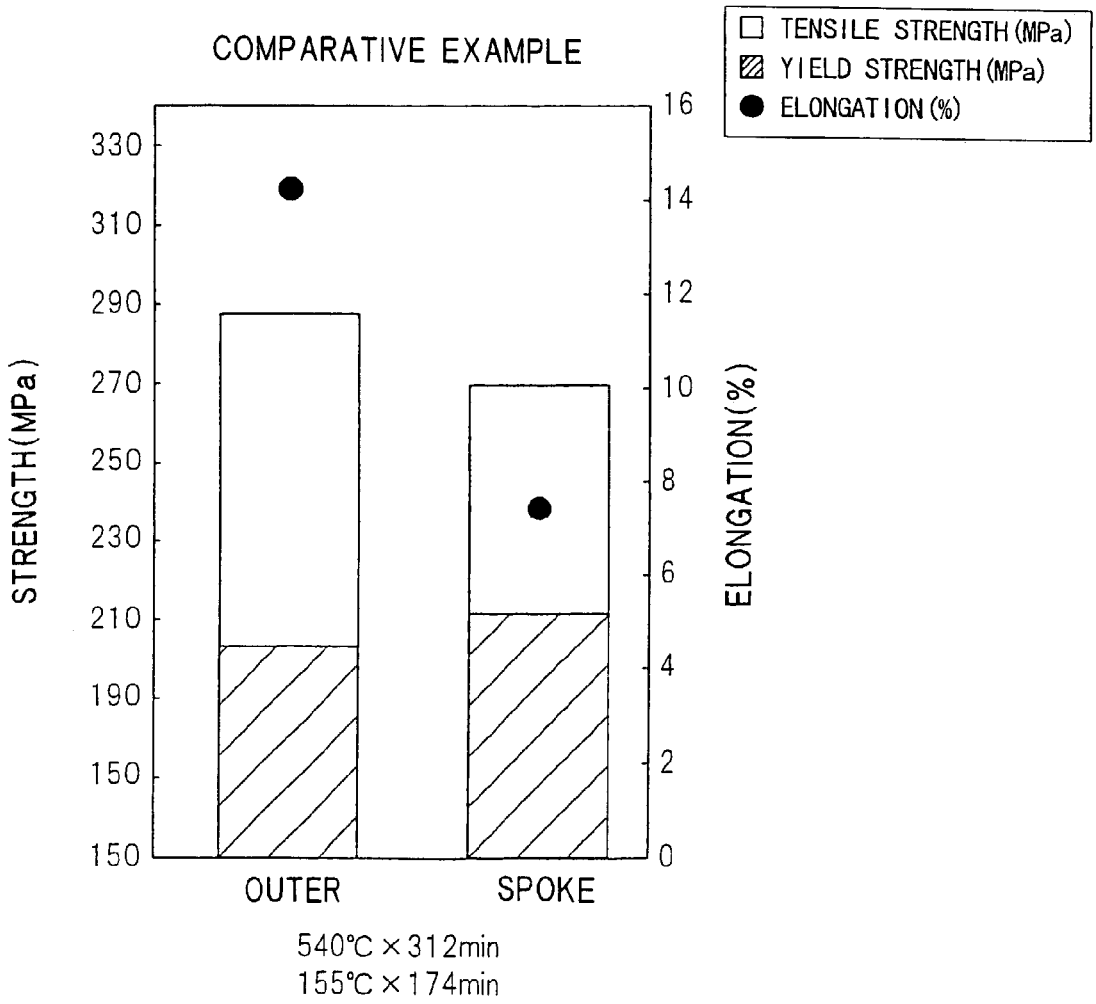
FIG. 10 is a graph showing the tensile test results in one comparative example.

The test pieces (n=4) were cut off from the heat-treated vehicle wheel, and tested for the tensile properties (tensile strength, 0.2% proof stress and elongation). The results are given in FIG. 10.

Discussion

The results of the tensile tests of the test pieces prepared in EXAMPLE and COMPARATIVE EXAMPLE indicate that the test piece from the outer rim flange heat-treated in EXAMPLE had a tensile strength of 326.2 MPa or more, 0.2% proof stress of 261.3 MPa or more and elongation of 12.9% or more, and that the aluminum wheel heat-treated in COMPARATIVE EXAMPLE was inferior in all of the above-described mechanical properties.

INDUSTRIAL APPLICABILITY

As described above, the hot air blowing type fluidized-bed furnace and heat-treatment apparatus of the present invention use the fluidized bed improved from the conventional one, need a lower investment cost and smaller space, and prevent thermal energy loss, and hence suitable for a heat treatment furnace for metals, e.g., Al alloy. The rotary heat-treatment furnace, and heat-treatment apparatus and method which use the rotary heat-treatment furnace need a lower investment cost due to reduced size of the equipment, smaller space and lower running cost resulting from reuse of thermal energy and prevented heat loss, and allow totally automatic operation to save manpower. Therefore, the metallic product heat-treated by the present invention has better mechanical properties, is produced at a lower cost, and hence can find more applications.

The invention claimed is:

1. A heat-treatment apparatus comprising:

a vessel for forming therein a fluidized bed composed of fluidized material formed from heated particles;

a cantilevered dispersion tube located in such fluidized bed when formed and having air outlets for blowing hot air therefrom; and means for rotating a metallic work piece during heat-treatment thereof, said means for rotating a metallic work piece being located above said dispersion tube, wherein said dispersion tube and said means for rotating a metallic work piece are located within such fluidized bed formed from particles in said vessel fluidized by hot air blown from said dispersion tube.

2. The apparatus according to claim 1, wherein said means for rotating a metallic work piece comprises:

a furnace floor located within the fluidized bed for supporting a work piece in the fluidized bed;

a rotating shaft attached to the furnace floor for rotating the furnace floor;

a barrier wall surrounding the rotating shaft; and a driving mechanism attached to said rotating shaft for rotating the floor and a work piece thereon in the fluidized bed, wherein said rotating shaft is located at the center of the furnace floor and isolated from the fluidized bed by the barrier wall.

3. The apparatus according to claim 1, wherein each vessel further comprises an introducing wall separating an outside space of each vessel from an inside space of said fluidized bed, said introducing wall comprising an inlet port for charging a work piece into each vessel and an outlet port for discharging a work piece out of each vessel.

4. The apparatus according to claim 3, wherein each vessel further comprises an air curtain and a dust collector, wherein at least one of said air curtain and said dust collector is located at said inlet and outlet ports.

5. The apparatus according to claim 4, wherein said inlet port also is for discharging a work piece from each vessel.

6. The apparatus according to claim 1, wherein each vessel further comprises a damper mechanism for preventing fluctuation of pressure in each vessel during a time when a work piece is charged or discharged.

7. The apparatus according to claim 3, further comprising a hot air inlet located below an opening of at least one of said inlet and said outlet ports.

8. The apparatus according to claim 1, wherein each vessel further comprises a first controlling means for automatically controlling temperature.

9. The apparatus according to claim 8, wherein each vessel further comprises a plurality of temperature-measuring instruments located at corners of each vessel, a gas flow adjusting valve, and said mechanism for automatically controlling temperature is for measuring temperature in each vessel with said plurality of temperature-measuring instruments, and, based on measured temperature levels, is for changing a gas flow rate with the gas flow adjusting valve to control temperature of hot air being blown into the fluidized bed, thereby controlling temperature in each vessel.

10. The apparatus according to claim 1, wherein said fluidized bed comprises an interface level and each vessel further comprises a controlling means for automatically controlling said fluidized bed interface level.

11. The apparatus according to claim 10, wherein each vessel further comprises at least one interface-sensing instrument and a particle feeder, and said means for automatically controlling fluidized bed interface level is for measuring an interface level with said at least one interface-sensing instrument installed at a corner of each vessel, and, based on the measured interface level, charges particles from the particle feeder located at the top of said vessel to control the fluidized bed interface level.

12. The apparatus according to claim 11, wherein each vessel further comprises an automatic carrier for charging and discharging a work piece into and out of said vessel.

13. The apparatus according to claim 12, wherein said automatic carrier is a gantry.

14. A method for heat-treatment of a metallic work piece, comprising:

providing a vessel for forming a fluidized bed therein;

blowing hot air from a dispersion tube to fluidize particles to form a fluidized bed in said vessel;

providing means for rotating a metallic work piece during heat-treatment of such work piece, said means for rotating a metallic work piece being located above said dispersion tube, wherein said dispersion tube and said means for rotating a metallic work piece are located within such fluidized bed.

15. The method according to claim 14, wherein a work piece is an aluminum wheel.

16. The heat-treatment apparatus of claim 1, wherein said dispersion tube comprises a pressure-regulating header and a plurality of branch tubes branching from said header.

17. The heat-treatment apparatus of claim 16, wherein said header tube is ring-shaped and the dispersion tube is substantially cylindrical and comprises nozzles.

18. The heat-treatment apparatus of claim 16, wherein said header tube is ring-shaped and the dispersion tube is substantially cylindrical and comprises holes having a small size relative to a diameter of the dispersion tube.

* * * * *